US006783083B1

(12) United States Patent
Barker

(10) Patent No.: US 6,783,083 B1
(45) Date of Patent: Aug. 31, 2004

(54) FLUID SPRAYING APPARATUS

(75) Inventor: Dennis Barker, Deeside (GB)

(73) Assignee: Onyx UK Limited, London (GB)

( * ) Notice: Subject to any disclaimer, the term of this patent is extended or adjusted under 35 U.S.C. 154(b) by 0 days.

(21) Appl. No.: 09/890,957

(22) PCT Filed: Feb. 11, 2000

(86) PCT No.: PCT/GB00/00458

§ 371 (c)(1),
(2), (4) Date: Dec. 27, 2001

(87) PCT Pub. No.: WO00/47331

PCT Pub. Date: Aug. 17, 2000

(51) Int. Cl.[7] ..... B05B 3/04

(52) U.S. Cl. ..... 239/237; 134/22.1; 134/22.18; 134/24

(58) Field of Search ..... 239/237, 240, 239/263.3, DIG. 1; 134/22.1, 22.18, 24, 181, 392

(56) References Cited

U.S. PATENT DOCUMENTS

| | | | | |
|---|---|---|---|---|
| 3,506,196 A | * | 4/1970 | Ramsey | 239/17 |
| 3,645,453 A | * | 2/1972 | Morgan | 239/237 |
| 3,655,130 A | * | 4/1972 | Patrick | 239/77 |
| 5,033,680 A | | 7/1991 | Schultz | |
| 5,460,331 A | | 10/1995 | Krajicek et al. | |
| 5,772,117 A | * | 6/1998 | Su | 239/240 |
| 5,984,203 A | * | 11/1999 | Rosenberg | 239/222.11 |
| 6,092,739 A | * | 7/2000 | Clearman et al. | 239/237 |
| 6,186,413 B1 | * | 2/2001 | Lawson | 239/205 |

FOREIGN PATENT DOCUMENTS

| | | |
|---|---|---|
| DE | A19507051 | 9/1996 |
| EP | A048091 | 3/1982 |
| EP | A712668 | 5/1996 |
| GB | A1245422 | 9/1971 |
| GB | A2134414 | 8/1984 |

* cited by examiner

*Primary Examiner*—Michael Mar
*Assistant Examiner*—Thach H Bui
(74) *Attorney, Agent, or Firm*—Birch, Stewart, Kolasch & Birch, LLP

(57) ABSTRACT

A fluid spraying apparatus (10) comprising a generally cylindrical body defining a longitudinal axis, which body comprises: a first fixed part (12) comprising inlet means (16) adapted for connection to a pumped supply of fluid, and turbine means (40, 42, 44) arranged to be driven by said fluid; and a second rotatable part (14) comprising gear means (46–60), and one or more nozzles (82) in fluid communication with the turbine means for outletting the fluid as one or more jets, which nozzles extend radially of the longitudinal axis, which rotatable part is drivable by the turbine means through said gear means such that said nozzles are caused to rotate about said longitudinal axis; characterized in that none of the nozzles extends radially of the longitudinal axis further than the body. The apparatus is adapted to operate at a working pressure of 4–8 bar to provide a flow-rate of 400–700 $m^3$/hr, and is thus suitable for use with low pressure pumps of the kind often found at oil refineries.

11 Claims, 3 Drawing Sheets

FLUID SPRAYING APPARATUS

This application is the national phase under 35 U.S.C. § 371 of PCT International Application No. PCT/GB00/00458 which has an International filing date of Feb. 11, 2000, which designated the United States of America and was published in English.

The present invention relates to a fluid spraying apparatus, and has particular reference to fluid spraying apparatus of the kind suitable for use in dislodging or resuspending sludge accumulated on the bottom of a crude oil storage tank.

Fluid spraying apparatus of this kind is disclosed by EP-A-0048091. The apparatus of EP-A-0048091 comprises a generally cylindrical body and two diametrically opposing nozzles that are arranged for rotation about the longitudinal axis of the body. The body comprises a fixed part and a rotatable part. The fixed part comprises an annular inlet portion defining an inlet passageway that accommodates a turbine, a mounting disk for mounting the turbine and an open-sided intermediate connecting portion between the inlet portion and the mounting disk. Said rotatable part includes generally cylindrical gear box portion that accommodates a gear train, that is connected between the rotatable part and the turbine, and a nozzle body portion that surrounds the open-sided intermediate connecting portion of the fixed part. Said nozzles are mounted on the nozzle body portion, each nozzle having the form of a truncated cone, the longitudinal axis of each cone being oriented substantially orthogonally to the longitudinal axis of the body.

In use, the apparatus is placed within a crude oil storage tank, and the inlet portion is connected to a pipe carrying a pumped supply of fluid, typically recirculating crude oil from the tank. The passage of the fluid over the turbine causes rotation of the rotatable part with respect to the fixed part, and thus rotation of the nozzles about the longitudinal axis of the body around the open-sided intermediate connecting portion of the fixed part. The fluid thus issues from the apparatus via the nozzles, and the length and taper of each nozzle are carefully selected so that the jet of liquid emerging has a comparatively small angle of spread.

A disadvantage of the fluid spraying apparatus of EP-A-0048091 is that owing to the back pressure generated within the nozzles, a high pressure pump is required.

A further disadvantage is that as the nozzles project to a substantial extent beyond the body of the apparatus, a large opening is required in a wall of the tank in order to insert the apparatus into the tank.

There is a requirement for a more compact fluid spraying apparatus which can be inserted through smaller openings in a crude oil storage tank as compared with those that are required for entry of the apparatus disclosed by EP-A-0048091. There is also a requirement for a fluid spraying apparatus which can be used with a low pressure pump of the kind that are readily available on site at oil refineries.

According to the present invention therefore there is provided a fluid spraying apparatus of the kind described comprising one or more of nozzles, characterised in that none of the nozzles extends radially of the longitudinal axis further than the body.

The fluid spraying apparatus of the present invention is thus extremely compact, and can be inserted through any aperture having a diameter greater than the maximum diameter of the body of the apparatus across the longitudinal axis thereof. Said apparatus may have a maximum diameter of no more than 46 cm (18 inches), and in one embodiment, the maximum diameter of the machine is 31 cm (12 inches).

Preferably the or each nozzle is generally frustoconical, and the longitudinal axis of each nozzle extends substantially orthogonally to the longitudinal axis of the body. The outer extremity of each nozzle preferably coincides with the outer extent of the rest of the machine. In some embodiments, the taper of each nozzle is in the range 10 to 40°, so as to minimise the back to pressure arising as a result of the constriction presented by the or each nozzle. Preferably, the taper of each nozzle is in the range 15 to 35°. The diameter of the opening in each nozzle will vary according to the specific application of the machine, but will generally be in the range 4–9 cm (1.5–3.5 inches). In some embodiments nozzle diameters of 5 cm (2 inches), 6.5 cm (2.5 inches) or 7.5 cm (3 inches) may be provided.

The body may comprise a first fixed part that is adapted to be connected to a pipe carrying a pumped supply of fluid and second rotatable part that is arranged for rotation about said longitudinal axis. Said nozzle(s) may be mounted on the rotatable part.

Said fixed part may comprise an annular inlet portion defining a passageway that accommodates a turbine arranged to be driven by fluid entering therein; a disk portion for mounting said turbine; and an open-sided connecting portion between the mounting disk portion and the inlet portion.

Said rotatable part may comprise a generally cylindrical gear box portion that accommodates a gear train connected between the turbine and the rotatable part; and a generally cylindrical nozzle body portion that surrounds the fixed part. Said nozzle(s) may be mounted on the nozzle body portion.

Preferably, two nozzles are provided, and these are ideally positioned diametrically opposite one another on the nozzle body portion around the open-sided intermediate portion of the fixed part. Thus, fluid entering the fixed part via the inlet portion debouches the apparatus through the open-sided connection portion of the fixed part and through the nozzle(s).

In some embodiments, the open-sided intermediate connecting portion of the fixed part may comprise a semi-cylindrical baffle wall that is connected between the annular inlet portion and the disk portion. It will be appreciated by those skilled in the art that as the nozzles rotate about the fixed part, the semi-cylindrical baffle wall thus serves to obturate each nozzle in succession. This arrangement is suitable where the fluid spraying apparatus is to be positioned within a tank adjacent a wall of the tank, so that fluid is prevented from being sprayed directly at the said wall in order to avoid damaging the wall.

Alternatively, the intermediate connecting portion may comprise a plurality of circumferentially spaced fingers which are dimensioned so as not to prevent any significant obstacle to the passage of fluid through the nozzle. In this case, the apparatus is suitable for use at or towards the centre of a crude oil storage tank, for example, away from the way, so that the jets of sprayed fluid emerging from the apparatus can be directed in all directions radially outwards of the longitudinal axis of the body.

The apparatus of the present invention is suitable for connection to a supply of fluid at a pressure of 4–8 bar, and is adapted to provide a flow rate of 400–700$m^3$/hr.

Following is a description by way of example only with reference to the accompanying drawings of embodiments of the present invention.

Figure 1:
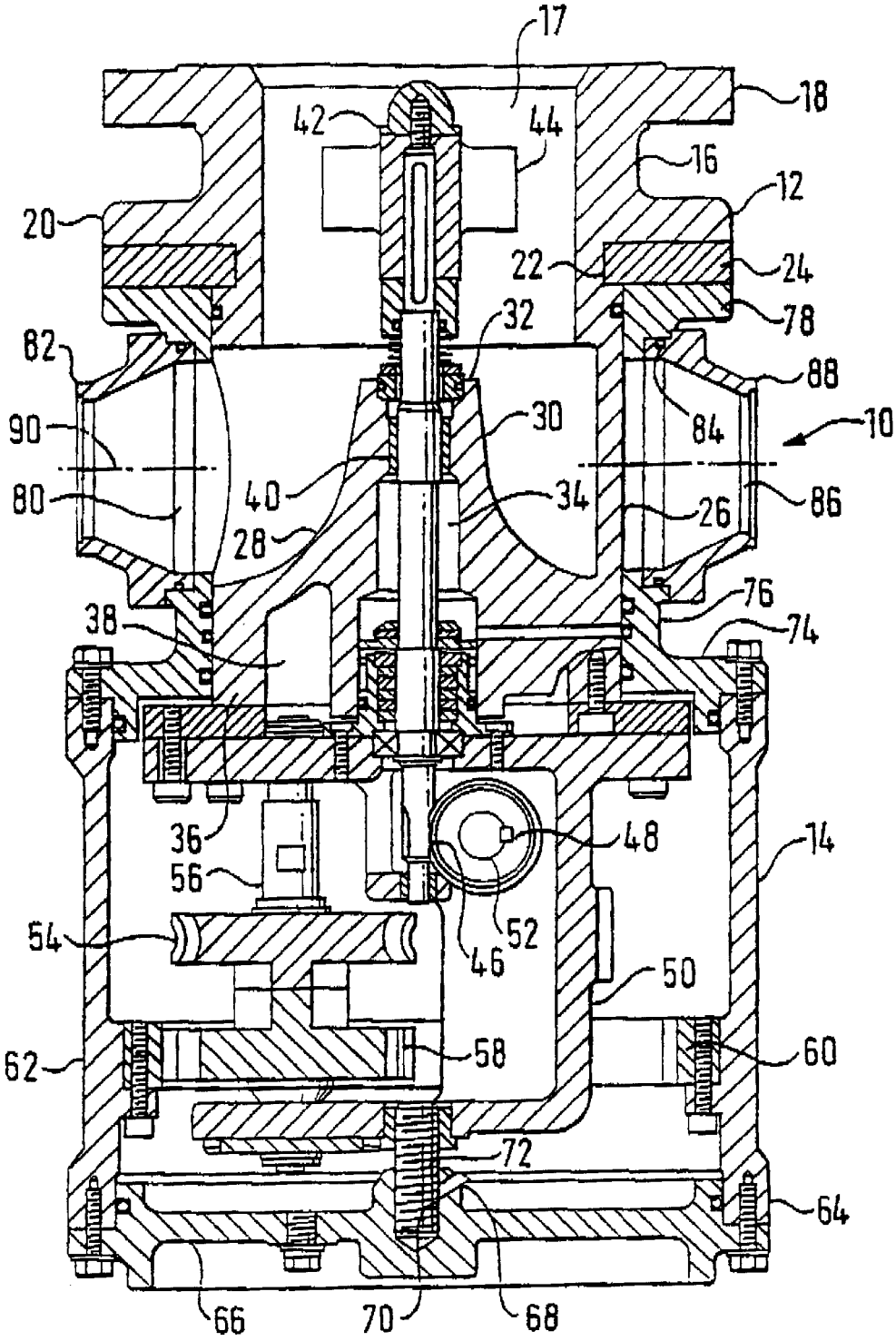
FIG. 1 is a cross sectional side view of a fluid spraying apparatus in accordance with a first embodiment of the present invention.

With reference to FIG. 1, a fluid spraying apparatus (10) in accordance with the present invention comprises a first fixed part (12) and a second rotatable part (14). Said first fixed part (12) comprises annular inlet portion (16) that is provided with a first flange (18) at one end, which first flange (18) is drilled at circumferentially spaced locations for attachment of the inlet portion (16) to a end of a pipe carrying a pumped supply of fluid.

Towards its other end, the inlet portion (16) is equipped with a second flange (20). Said inlet portion (16) is rebated juxtaposed the second flange (20) at (22) to accommodate a low friction ring (24) which forms a rotatory bearing.

Said inlet portion (16) is formed integrally with a coaxial, semi-cylindrical portion (26), which semi-cylindrical portion (26) is connected at its lower end to a central body portion (28). Said central body portion (28) is circular in cross section and has a bell-shaped upper portion (30) that extends juxtaposed the semi-cylindrical portion (26) towards the inlet portion (16). Said bell-shaped portion (28) is disposed substantially coaxially with the inlet portion (16), and the upper extremity of the bell-shaped portion (28) has a flat, circular surface (32) that is drilled centrally to provide an open bore (34) that extends axially through the central body portion (28). Said central body portion (28) has a flat, circular lower surface (36) that is scalloped at four circumferentially spaced locations to provide cut-outs (38).

Said open bore (34) accommodates a shaft (40) which carries at one end, within the central passageway (17) through the inlet portion (16), a propeller (42) comprising four turbine blades (44). The other end of the shaft (40) protrudes from the lower surface (36) of the central body portion (28) is formed with an external worm (46) which engages a worm wheel (48). Said worm wheel (48) is mounted on a bracket (50) that is fixedly secured to the lower surface of the central body portion (28).

Said worm wheel (48) is mounted on a shaft (52) that is provided with a second worm (not shown). Said second worm engages a second worm wheel (also not shown) which is mounted on a further shaft (also not shown). Said further shaft is provided with a third worm (also not shown) which engages a worm wheel (54). Said worm wheel (54) is mounted on a shaft (56). A spur wheel (58) is keyed to the shaft (56), which spur wheel (58) engages a ring gear (60) which is mounted on an inner surface of a cylindrical gear casing (62) of the rotatable part (14).

Said gear casing (62) surrounds the above described gear train and is closed at its lower end (64) by a circular bottom plate (66), The inner surface of the bottom plate (66) is provided with a central lug (68) that is drilled to provide a blind bore (70), which blind bore (70), accommodates an end of a stub shaft (72), the other end of which is journalled on the bracket (50) so as to locate the lower end of the bracket (50) within the gear casing (62).

The upper end of the gear casing (62) is bolted to an annular flange (74) formed on a generally cylindrical nozzle body (76). Said nozzle body (76) forms a snug fit around the semi-cylindrical portion (26) and is provided at its upper end with a second flange (78) that engages the low friction ring (24).

Said nozzle body (76) is provided with two diametrically opposed circular apertures (80), and the nozzle body (76) is rebated around the circumference of each aperture (80). A nozzle (82) is fixedly secured to the nozzle body (76) at each aperture (80). Each nozzle (92) is generally frustoconical in shape and, at the wider end, is equipped with a rebated portion (84) that is accomnodated within the rebate formed around the aperture (80). Each nozzle is hollow and is formed with a circular opening (86) at its narrower end (88).

As can be seen from FIG. 1, each nozzle is positioned such that its longitudinal axis (90) is oriented substantially orthogonally to the longitudinal axis defined by the shaft (40).

Figure 2:
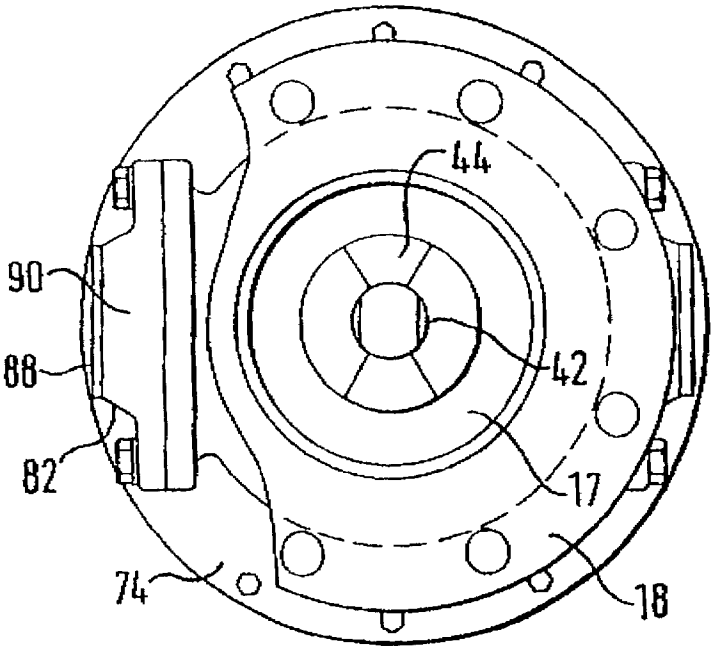
FIG. 2 is a plan view of the first embodiment.

As can be seen from FIG. 2, the length of each nozzle (82) radially of the shaft (40) is such that the outer extremity of the nozzle coincides with and does not protrude radially of the outer extent of the rest of the apparatus. In the embodiment shown, the widest part of the apparatus is the flange (74) on the nozzle body (76) that is secured to the cylindrical gear casing (62). As can be seen from FIG. 2, the nozzles (82) are disposed wholly within the outline of the flange (74). This represents an advantageous arrangement as it allows a compact fluid spraying apparatus which can be inserted in narrow manways which are only slightly larger than the outer diameter of the flange (74). Whilst the actual size of the apparatus in accordance with the present invention may vary depending upon the intended application of the apparatus, in the present embodiment, said flange (74) has an outer diameter of 305 mm (12").

Figure 3:
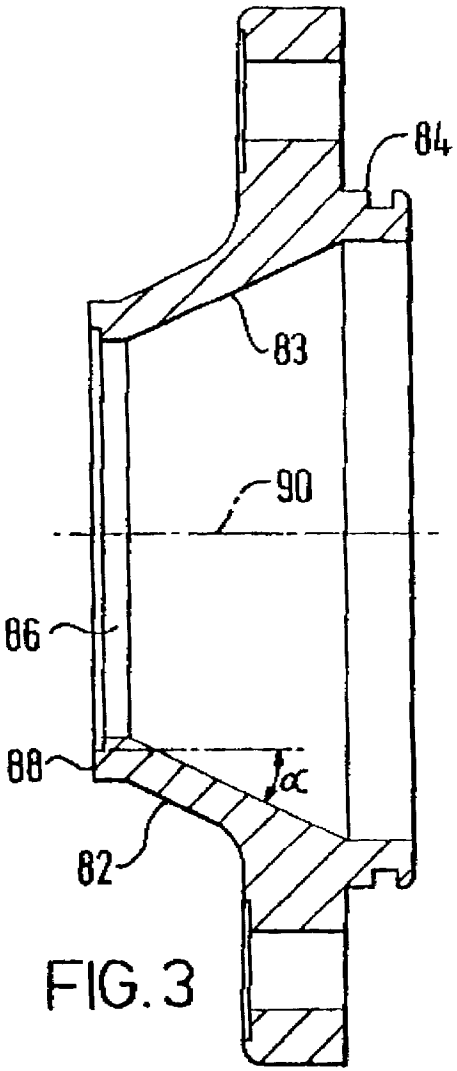
FIG. 3 is a cross sectional side view through a nozzle of the first embodiment.

Said nozzles (82) are designed to provide minimum back pressure to fluid passing therethrough. With reference to FIG. 3, the angle $\propto$ subtended by the internal surface (83) of each nozzle (82) to the longitudinal axis (90) of the nozzle is an important factor in ensuring that the fluid issues from the nozzles as a convergent jet, whilst at the same time providing minimum back pressure and thus allowing the use of a low pressure pump. In the first embodiment, angle $\propto$ is 25°, although more generally an angle in the range 15 to 35° may be adopted, with particularly preferred angles being 16.5° and 33°. Again, the actual size of the nozzles may vary according to the proposed use of the apparatus but in the embodiment shown, the diameter of the opening (86) in each nozzle (82) is 6.5 mm (2.5 inches).

In use, the fluid spraying apparatus (10) is inserted through a manway into a crude oil storage tank and is positioned juxtaposed a wall of the tank at a pressure of 4–8 bar. Conveniently a low pressure pump of the kind often found at oil refineries may be used for pumping the oil. The inlet portion (60) is connected to an end of pipe carrying a pumped supply of recirculating crude oil from the tank. As the oil flows through the inlet passage (17), it interacts with the propeller (42) causing the shaft (40) to rotate. In turn, the shaft (40) acts through the gear train described above causing the rotatable part (14) of the assembly, comprising said gear casing (62) and nozzle body (76), to rotate. Typically, the step-down ratio of the gear train is such as to provide one complete rotation of rotatable part (14) of the apparatus every two to four hours.

From the inlet passageway (17), the oil passes into the space around the bell-shaped portion of the central body portion (30) and exits the apparatus through the apertures (80) and nozzles (82) at a flow rate of 400–700$m^3$/hr, depending on the actual nozzle size and configuration, and the pressure of the oil supplied to the apparatus. It will be appreciated that as each nozzle rotates passed the semi-cylindrical portion (26), the nozzle is obturated, thus preventing fluid from entering that nozzle. This means that in the apparatus of the first embodiment, oil is only able to issue from one nozzle at a time. Preferably the arc length of the semi-cylindrical portion (26) is greater than 180°. The apparatus (10) is thus positioned in the tank, so that the semi-cylindrical wall (26) is positioned adjacent the wall of the tank, so that the jet of oil emerging from the apparatus (10) is directed away from the wall, so as to avoid damaging the wall.

Figure 4:
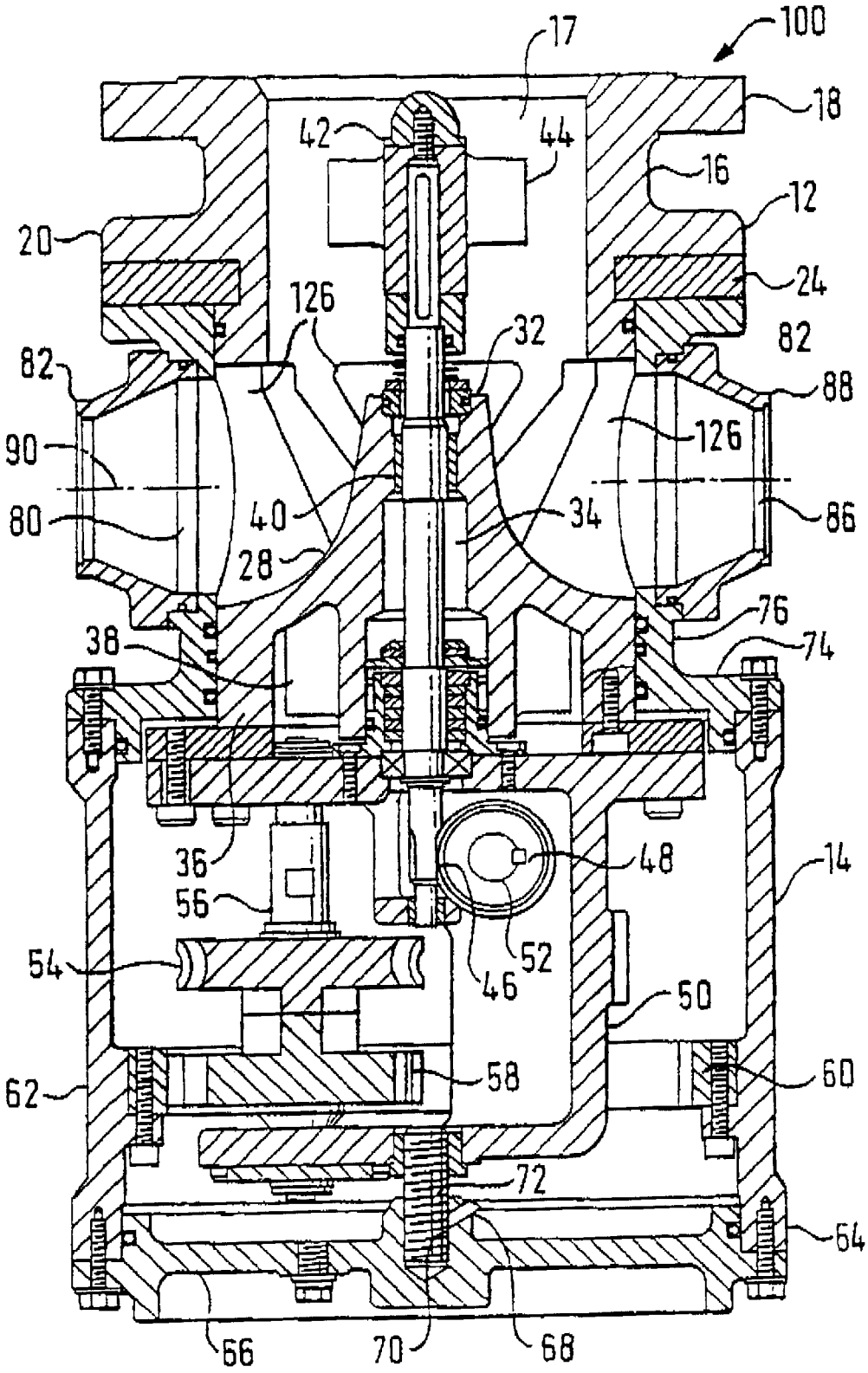
FIG. 4 is a cross sectional side view of a fluid spraying apparatus in accordance with a second embodiment of the present invention.

FIG. 4 shows a second embodiment of the invention which is suitable for use at or towards the centre of the crude oil storage tank. In the second embodiment, the majority of components are the same or substantially similar to the components of the first embodiment, and for these the same reference numerals are used.

The apparatus (100) of the second embodiment differs from the first embodiment however in that the semi-cylindrical portion (26) of the first embodiment is replaced by a plurality of circumferentially spaced fingers (126) that extend between the central body portion (28) and the inlet portion (16). In the second embodiment illustrated in FIG. 4, four such fingers (126) are provided, with three being visible in the drawings. In the second embodiment, the fingers (126) provide the required connection between the inlet portion (16) and the central body portion (28) of the fixed part (12) of the apparatus, but are dimensioned so as not to provide any significant obstruction to the passage of oil. Oil is therefore able to issue through both nozzles (82) at the same time, and thus the jets are directed across the whole 360° of rotation of the rotatable part (14) of the apparatus.

Whilst the invention has been described by reference to apparatus incorporating two nozzles (82), those skilled in the art will appreciate that the apparatus hereinbefore described can readily be adapted to incorporate three or more nozzles as required.

What is claimed is:

1. A fluid spraying apparatus for dislodging or re-suspending sludge in an oil storage tank, said apparatus comprising a generally cylindrical body defining a longitudinal axis, which body comprises:

a first fixed part comprising an inlet, a central body portion, and a longitudinal connecting portion between said central body portion and said inlet portion, wherein said inlet portion is adapted for connection to a pumped supply of fluid and defines a passageway;

turbine means mounted on said central body portion, said turbine means comprising a turbine that is positioned in said passageway to be driven by fluid entering therein;

a second rotatable part comprising a nozzle body, and one or more generally frustoconical nozzles that are positioned on said nozzle body around said longitudinal connecting portion in fluid communication with said turbine for outletting the fluid as one or more jets; and gear means connected between said turbine means and said second rotatable part; wherein said rotatable part is drivable by said turbine means through said gear means such that said one or more nozzles are caused to rotate about said longitudinal axis; and wherein at least one of the nozzles extends radially of said longitudinal axis and has a taper in the range of 10 to 40° so as to produce a convergent jet for dislodging or re-suspending sludge while minimizing the back pressure, and none of the nozzles extends radially of the longitudinal axis further than the body.

2. A fluid spraying apparatus as claimed in claim 1, wherein at least one of the nozzles has an outer extremity that coincides with the outer extent of the rest of the apparatus.

3. A fluid spraying apparatus as claimed in claim 1, wherein the longitudinal axis (90) of each nozzle extends substantially orthogonally to the longitudinal axis of the body.

4. A fluid spraying apparatus as claimed in claim 2, wherein the taper of each nozzle is in the range of 15 to 35°.

5. A fluid spraying apparatus as claimed in claim 3, wherein each nozzle has an opening having a diameter in the range of 4–9 cm.

6. A fluid spraying apparatus as claimed in claim 1, wherein said rotatable part comprises a generally cylindrical gear box portion that accommodates a gear train connected between the turbine and the rotatable part; and a generally cylindrical nozzle body portion that surrounds the fixed part.

7. A fluid spraying apparatus as claimed in claim 1, wherein two nozzles are provided, which nozzles are positioned diametrically opposite one another on the nozzle body portion around the longitudinal connecting portion of the fixed part.

8. A fluid spraying apparatus as claimed in claim 1, wherein said longitudinal connecting portion of the fixed part comprises a semi-cylindrical baffle wall that is connected between the inlet portion and the central body portion.

9. A fluid spraying apparatus as claimed in claim 1, wherein the longitudinal connecting portion comprises a plurality of circumferentially spaced fingers which are dimensioned so as not to prevent any significant obstacle to the passage of fluid through the nozzle.

10. A fluid spraying apparatus as claimed in claim 1, wherein the maximum outer diameter of the apparatus is not greater than 32 cm (12").

11. A fluid spraying apparatus as claimed in claim 1, which is adapted to operate at a working pressure of 4–8 bar to provide a flow-rate of 400–700$m^3$/hr.

* * * * *